United States Patent [19]

Hazard et al.

[11] 4,377,247

[45] Mar. 22, 1983

[54] DISPENSING CLOSURE EMPLOYING LIVING HINGE

[75] Inventors: Robert E. Hazard, Kingstown; Woodrow S. Wilson, Johnston, both of R.I.

[73] Assignee: Polytop Corporation, Slatersville, R.I.

[21] Appl. No.: 171,386

[22] Filed: Jul. 23, 1980

Related U.S. Application Data

[63] Continuation-in-part of Ser. No. 956,435, Oct. 31, 1978, Pat. No. 4,220,248.

[51] Int. Cl.[3] ..... B65D 25/48

[52] U.S. Cl. ..... 222/517; 222/543; 222/546; 215/235; 220/335

[58] Field of Search ..... 222/498, 517, 543, 546, 222/562; 215/235, 238, 244, 306; 220/335, 339, 375, 254; 16/150

[56] References Cited

U.S. PATENT DOCUMENTS

| | | | |
|---|---|---|---|
| 3,155,285 | 11/1964 | Van Baarn | 222/153 |
| 3,240,405 | 3/1966 | Abbott | 222/546 X |
| 3,752,371 | 8/1973 | Susuki et al. | 222/182 |
| 3,877,598 | 4/1975 | Hazard | 222/546 X |
| 4,010,875 | 3/1977 | Babiol | 222/517 |
| 4,159,902 | 6/1979 | Chernack et al. | 222/517 X |
| 4,172,540 | 10/1979 | Erichson | 222/517 |
| 4,244,495 | 1/1981 | Lorscheid et al. | 222/556 X |

FOREIGN PATENT DOCUMENTS 1075949 7/1967 United Kingdom .

*Primary Examiner*—Charles A. Marmor

*Attorney, Agent, or Firm*—Martin P. Hoffman; Mitchell B. Wasson

[57] ABSTRACT

A unitary dispensing closure having a lid mounted on a closure part or base in such a manner that the lid will automatically move toward either a closed or an opened position when it is released after being manipulated to any position between these two positions can be constructed so as to utilize the resiliency within a "live" hinge to provide the force necessary to move the lid. In any position intermediate these two positions the hinge connects to the lid and closure part or base so that contact between the lid and closure part causes temporary deformation of the hinge. As a result of the resiliency of the material in the hinge such temporary deformation is adequate to move the lid as described.

6 Claims, 4 Drawing Figures

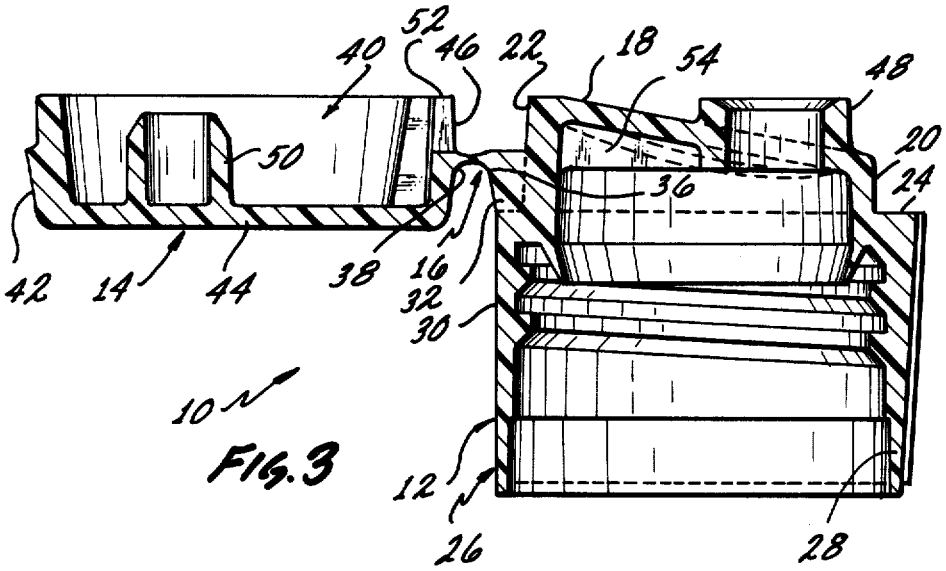
FIG. 3
FIG. 4
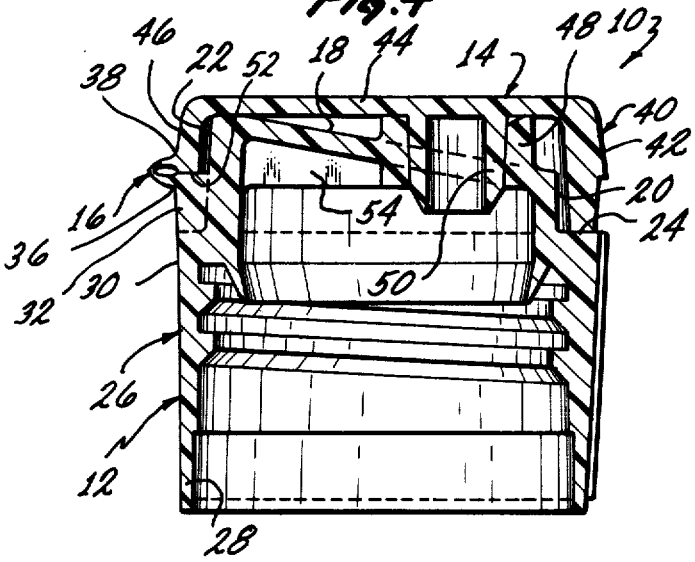

DISPENSING CLOSURE EMPLOYING LIVING HINGE

CROSS-REFERENCE TO RELATED APPLICATIONS

This invention is a continuation-in-part of my invention set forth in application Ser. No. 956,435 filed Oct. 31, 1978 entitled "CLOSURE WITH HINGED LID AND CAM AND SPRING ELEMENTS HOLDING LID OPEN OR CLOSED", now U.S. Pat. No. 4,220,248 issued Sept. 2, 1980, the entire disclosure of which is herein incorporated by reference.

BACKGROUND OF THE INVENTION

The invention sets forth in this specification pertains to new and improved dispensing closures. More specifically this invention pertains to unitary dispensing closures in which a lid is mounted upon a closure part or base such as is normally adapted to be secured to a container in such a manner that the lid may be manipulated between open and closed positions, and in which as a result of the construction employed the lid will tend to automatically move toward either an open or closed position when it is released after having been manipulated to any position between these two positions. Dispensing closures of the type described in the preceding discussion are sometimes referred to as "snap action" closures.

As a result of economic considerations increasing numbers of users of dispensing closures appear to desire to utilize one-piece, unitary dispensing closures instead of two-piece dispensing closures in which the parts are separately manufactured and then assembled together. As a result of this, significant amounts of work have been devoted toward the development of new and improved one-piece dispensing closures.

Much of this development work has been directed toward the construction of one-piece dispensing closures which are constructed in such a manner as to include a lid mounted on or connected to a base or similar closure part in such a manner that the lid will not stay at rest in a position in which the lid partially blocks access to an opening through the clousure part or base.

It is not considered that an understanding of the present invention requires a detailed review of the various dispensing closures which have been developed so as to contain a lid which will automatically move toward either an open or closed position after having been manipulated to a position between these two positions and then released. Those prior structures which are closely related to the structures of the present invention are considered to be of a utilitarian, useful character. However, it is considered that these prior related structures which will operate in the manner indicated are comparatively disadvantageous for various different reasons.

Certain of such prior "automatic" type dispensing closures are constructed so that one or more functional or operative parts of such closures tend to be exposed in such a manner that there is a resonable possibility of damage to such parts during the installation of such closures on containers using capping equipment and so that there is a lesser continuing possibility of damage to such parts during handling and use of such closures. Some of such dispensing closures are also considered to be undesirable because they include various extending parts, such as posts, blades or the like which may be ojbectionable from an appearance standpoint or because of the possibility of accumulations around or adjacent to them. In general, such prior "automatic" type dispensing closures which preceded the present invention have been designed so that two and frequently more parts of such closures are of a "critical" character in that such parts must be designed with great care in order to obtain a desired manner or mode or operation.

As a result of these considerations and the possibility of patent infringement problems it is considered that there is a need for new and improved dispensing closures of the type indicated in the preceding discussion. More specifically it is considered there is a need for such closures which operate satisfactorily, which are capable of being easily installed without significant danger of damage, which have a minimum of parts, which are desirable because of their shape and configuration, and which are of such a character that they can be easily designed in accordance with standard design practice as hereinafter indicated.

BRIEF SUMMARY OF THE INVENTION

It is believed it will be apparent from the preceding discussion that the invention is intended to fulfill the various need enumerated in the preceding discussion. Thus, the invention is intended to provide new and improved dispensing closures such as are on occasion referred to as "snap action" closures. The invention is also intended to provide closures of the type indicated which may be easily and conveniently designed, molded, and installed on various different types of containers. Further, the closures of the invention are intended to be relatively immune from damage during installation and handling and are intended to operate satisfactorily for relatively long periods. These closures are also intended to be desirable from an economic standpoint.

In accordance with this invention these various objectives are achieved by providing a unitary closure formed of a polymer composition which is capable of being used in a "live" hinge and which is of a self-supporting, resilient character, said closure being shaped so as to include a hollow closure part, a lid part and a live hinge means connecting said closure and said lid parts, said closure part including a top and a bottom extending beneath said top around the periphery of said top so as to enclose the interior of said closure part, said bottom including means for attaching said closure to a container, said hinge means connecting said closure and said lid parts so that said lid part may be pivoted about an axis of said hinge means into and out of a closed position in which said lid part covers the top of said closure part in which the improvement comprises: dependent means on said lid part extending downwardly when said lid part is in said closed position, said hinge means being located so that said dependent means engages a portion of said bottom during movement of said lid into and out of said closed position, said engagement of said dependent means and said portion of said bottom serving to create sufficient temporary deformation within said closure so that said lid will automatically move toward said closed position or toward an open position in which said lid extends generally away from said top of said closure part when it is released after being manipulated to any position between said open and closed positions.

BRIEF DESCRIPTION OF THE DRAWINGS

The invention is best more fully described with reference to the accompanying drawings in which:

FIG. 3 is a cross-sectional view taken at line 3—3 of FIG. 2; and

FIG. 4 is a cross-sectional view similar to FIG. 3 of a closure of the present invention when closed.

Figure 1:
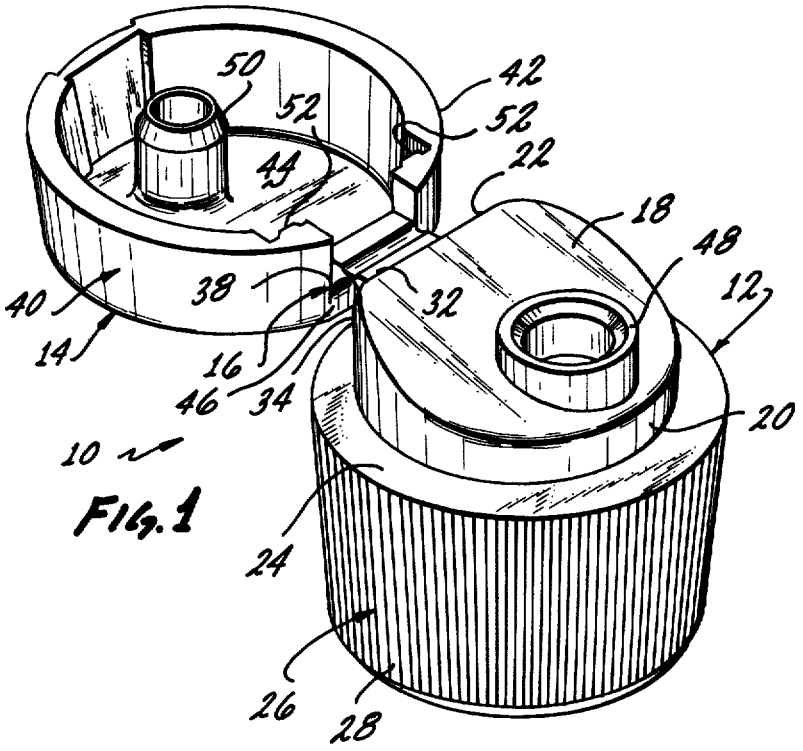
FIG. 1 is an isometric view of a presently preferred embodiment or form of a dispensing closure of the present invention in a completely open position or configuration as this closure is produced as a result of an injection molding operation.
Figure 2:
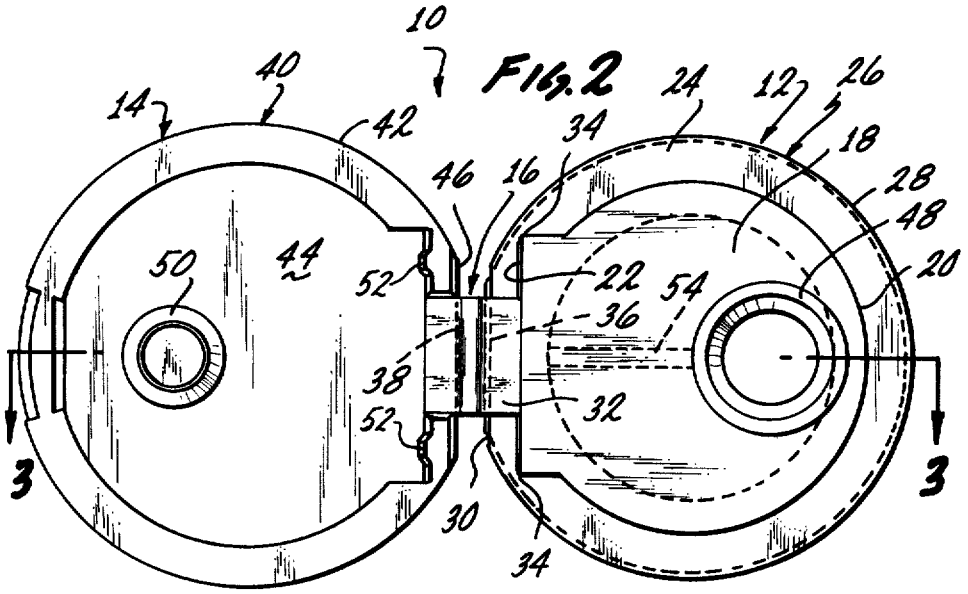
FIG. 2 is a top plan view of the entire closure shown in FIG. 1 with the parts in the configuration shown in FIG. 1.

The dispensing closure illustrated in the drawings utilizes the concepts or principles of the invention set forth and claimed in the appended claims. Those familiar with the design and construction of one-piece dispensing closures will realize these concepts can be employed in a variety of closures which differ from the specific closures illustrated in the drawing as to matters within the scope of routine engineering skill in the noted field.

DETAILED DESCRIPTION

In the drawing there is shown a dispensing closure 10 in accordance with the present invention which is constructed as a unitary body of a polymer such as polypropylene which can be utilized in the formation of a so-called "live" hinge. It is considered that this expression "live hinge" is sufficiently recent so as not to be precisely defined in various commonly available textbooks and the like. Generally speaking a "live hinge" may be defined as a hinge formed by a thin line-like web of material extending between two rigid or comparatively rigid parts which is designed to flex about an axis in substantially the same manner in which the two parts of a conventional hinge are pivotally connected so as to permit rotation about an axis. Normally it is preferred that such a live hinge is approximately 10 to 15/1000 of an inch in thickness along a line extending throughout its length. It is considered that it is possible for such a hinge to be from about 5 to about 25/1000 of an inch thick along such a web or line. The width of such a web of such thickness should be as small as reasonably possible consistent with the hinge being capable of folding along an axis approximately 180 degrees.

"Live" hinges of the type referred to in this discussion are commonly utilized in a wide variety of different products. Appropriate literature such as literature published by manufacturers of polymer compositions go into greater detail than this specification as to all of the criteria involved in designing a "live" hinge as indicated in the preceding discussion. It is considered that any such composition which is useful in a live hinge will possess sufficient inherent resiliency and be of a sufficiently self-supporting character as to be capable of being used in the construction of the closure 10.

This particular closure 10 is shaped by conventional injection molding techniques so as to include a hollow closure part 12, a lid part 14 and a "live" hinge or hinge means 16 connecting the closure and lid parts 12 and 14. This closure part 12 includes a sloping top 18 which is surrounded by a comparatively short, vertically extending wall 20. This wall 20 includes a flat wall 22. It will be noted that the top 18 extends or slopes downwardly from immediately adjacent to the flat wall 22. The shape of this top 18 can of course be varied to a degree as desired for aesthetic considerations. Thus, for example, it can have a somewhat concave shape as indicated by the dotted lines in FIG. 3.

The wall 20 including the flat wall 22 is surrounded by an inwardly directed top shoulder 24 which surmounts a bottom 26. This bottom 26 has substantially the shape of a cylinder 28 interrupted by a chordal wall 30. This chordal wall 30 is parallel to the flat wall 22 and is spaced outwardly from it. A holder 32 is located on the shoulder 24 immediately above the wall 30. This holder 32 is of a box-like shape and is located centrally along the flat wall 22 between the ends 34 of this wall 22. This holder 32 is also centrally positioned relative to the wall 30 so as to a degree to constitute an extension of the wall 30. This holder 32 also is approximately one-half of the height of the flat wall 22.

The purpose of this holder 32 is to provide a rear line-like edge 36 carrying the live hinge 16 so as to connect the closure part 12 with a similar edge 38 on the lid part 14. This edge 38 is formed in a dependent skirt 40 on the lid part 14 which extends completely around the periphery 42 of the top 44 of the lid part 14. This periphery 42 closely approximates the configuration of the intersection of the bottom 26 and the shoulder 24. The skirt 40 is of a corresponding shape and is constructed as shown so as to be capable of fitting against the shoulder 24 as indicated in FIG. 4 of the drawing so that the top 44 extends transversely to the axis (not indicated) of the cylinder 28. It is noted that the edge 38 on the skirt 40 is located along a flat portion 46 of the skirt 40 which appears more or less as an extension of the wall 30 when the lid part 14 is in a position as indicated in FIG. 4.

When the lid part 14 is in a position as indicated in FIG. 4 it is in what is normally referred to as a "closed position". In this closed position a nozzle or spout 48 extending through the above the top 18 of the closure part 12 is sealed off by a dependent plug 50 carried by the top 44 of the lid part 14. This lid part 14 may be rotated from a closed position as indicated in FIG. 4 to an open position in which the lid part 14 extends substantially vertically with the top 44 parallel to the wall 30. It also may be rotated from such a closed position to a further extent to a position as indicated in FIG. 1. This is quite beneficial in enabling the complete closure 10 to be easily manufactured using comparatively inexpensive dies.

Because of the construction of the closure 10 previously described, as the lid part 14 is rotated between the two positions noted the edges 52 of the skirt 40 on the flat portion 46 adjacent to the edge 38 will hit against the flat wall 22. This will set up or cause temporary deformation in the closure 10 which will cause the lid part 14 to automatically move toward either the closed position or the open position as noted in the preceding when it is released after being manipulated to any position between these two positions.

It is possible to design the closure 10 in several different manners in order to achieve the mode of operation indicated in the preceding. Thus, it is at least theoretically possible to design into the closure 10 a significant amount of flexibility and resiliency in the portion 46 of the skirt 40 adjacent to the edges 52 and/or into the flat wall 22 and adjacent portions of the closure part 12 so as to enable the closure 10 to operate as previously described in the absence of any spring action being achieved from the hinge 16. This use of resiliency and flexibility in either the lip part 14 or the closure part 12 or both is considered to be relatively undesirable with the present invention because normally it will be comparatively difficult to design parts of such dimension as to obtain exactly or substantially the degree of ease of manipulation between the two positions indicated plus the desired effectiveness of the automatic moving action described desired in a particular application With the present invention it is preferable that all parts of the closure 10 except the hinge 16 be constructed of sufficient massiveness so that as the closure 10 is manipulated as described there is no significant or normally apparent deformation except along the length of the hinge 16. In the preferred construction of the closure 10 the hinge 16 not only serves as a hinge but in addition serves as a spring which is deformed and distorted as the lid part 14 is manipulated between open and closed positions as indicated in the preceding discussion. It is considered that it is quite surprising that a live hinge 16 will serve in a closure such as the closure 10 both as a hinge so as to permit pivoting about an axis and in addition will serve as an adequate spring to cause automatic movement as indicated in the preceding discussion.

This is quite important. The hinge 16 used can be designed in accordance with conventional design practice used in the design of live hinges in other environments. As a result of this fact it is considered relatively simple to design a closure corresponding to the closure 10 without the designer having to be concerned as to the criticality of the dimensions and thicknesses of any of the parts except that of the hinge 16. This makes it comparatively simple to design a desirable closure corresponding to the closure 10 without significant experimentation.

Normally the designer of a closure such as the closure 10 will be somewhat concerned with the design of all parts of the closure so as to minimize the use of material to as great an extent as possible so as to provide a structure which will not exhibit to a user undesirable shrinkage, and to provide a structure which is reasonably desirable from an aesthetic standpoint and from the standpoint of minimizing the possibility of accumulations on the closure tending to create an unsightly or contaminated condition. Therefore, it is not to be presumed from the preceding that only a hinge 16 is important in a closure 10. Amongst the various modifications a routine designer could make when designing the closure 10 would be to provide an internal wall or web 54 beneath the top 18 serving to facilitate removal from a mold.

Because of the nature of the construction employed in the closure 10, it is significant in that the closure 10 does not require on the closure part 12 any separately formed or separately extending elements which co-act with corresponding elements on the lid part 14 in order to achieve the desired mode of automatic operation when the lid part 14 is released after being manipulated between open and closed positions as described. This of course minimizes the complexity of a die required to produce a closure such as the closure 10. It also helps avoid potential areas on the closure 10 which might accumulate contaminations of one sort or another. To a large extent it can be considered that the closure 10 is desirable because it utilizes a wall required in the closure part 12 to close off the interior of the closure part 12 as a functional element which cooperates with the lid part 14 so as to minimize the parts required in this closure 10.

We claim:

1. A unitary closure formed of a polymer composition which is capable of being used in a "live" hinge and which is of a self-supporting resilient character, said closure being shaped so as to include a hollow closure part, a lid part and a live hinge means connecting said closure and said lid parts, said closure part including a top and a bottom extending beneath said top around the perhiphery of said top so as to enclose the interior of said closure part, said bottom including means for attaching said closure to a container, said hinge means connecting said closure and said lid parts so that said lid part may be pivoted about an axis of said hinge means into and out of a closed position in which said lid part covers the top of said closure part in which the improvement comprises:

dependent means on said lid part extending downwardly when said lid part is in said closed position, said hinge means being located so that said dependent means engages a portion of said bottom during movement of said lid into and out of said closed position, said engagement of said dependent means and said portion of said bottom serving to create sufficient temporary deformation within said closure so that said lid will automatically move toward said closed position or toward an open position in which said lid extends generally away from said top of said closure part when it is released after being manipulated to any position between said open and closed positions, said portion of said bottom is a flat wall, said hinge means is a single live hinge having a hinge axis, said hinge axis being parallel to said flat wall, said closure part includes a holder forming a part of said bottom, said holder extending outwardly from said flat wall, said hinge means being located on said holder so that its axis is spaced from said flat wall and said top and is located above the bottom of said flat wall and below the top of said flat wall, said lid includes a dependent skirt, said skirt extending around the periphery of said lid between the ends of said hinge means, the portions of said skirt adjacent to the ends of said hinge means serving as said dependent means, said bottom has the shape of a cylinder interrupted by a chordal plane extending parallel to the axis of said cylinder which is provided with an inwardly directed top shoulder surmounted by a vertically extending wall, said flat wall forming a part of said vertically extending wall, said shoulder also being surmounted by said holder so that said holder appears as an extension of said chordal plane, said vertically extending wall being closed by said top of said closure part.

2. A closure as claimed in claim 1 wherein:

an opening extends through said top of said closure part, said lid includes sealing means for closing off said opening when said lid is in said closed position.

3. A closure as claimed in claim 2 wherein:

said skirt appears as an extension of said bottom of said closure part when said lid is in said closed position.

4. A closure as claimed in claim 1 wherein:

said top of said closure part includes a spout extending through said top of said closure part and above the remainder of said top of said closure part, said lid includes sealing means engaging said spout so as to close off said spout when said lid is in said closed position.

5. A closure as claimed in claim 4 wherein:

said skirt appears as an extension of said bottom of said closure part when said lid is in said closed position.

6. A closure as claimed in claims 1, 3, 5 wherein:

said portion of said bottom and said dependent means are sufficiently thick and rigid so as to be substantially incapable of deformation, and said temporary deformation within said closure during movement between said open and closed positions takes place with said hinge means.

* * * * *